US005277502A

United States Patent [19]

Kim

[11] Patent Number: 5,277,502

[45] Date of Patent: Jan. 11, 1994

[54] DEVICE FOR LOADING INK FILM AND PRINTING PAPERS IN COLOR VIDEO PRINTER

[75] Inventor: Jae S. Kim, Kyungki, Rep. of Korea

[73] Assignee: Goldstar Co., Ltd., Seoul, Rep. of Korea

[21] Appl. No.: 660,717

[22] Filed: Feb. 22, 1991

[30] Foreign Application Priority Data

Feb. 28, 1990 [KR] Rep. of Korea ..... 2386/1990

[51] Int. Cl.[5] ..... B41J 35/24

[52] U.S. Cl. ..... 400/196; 400/208; 400/625; 271/161

[58] Field of Search ..... 400/191, 194, 196, 624, 400/625, 691, 693.1, 208, 613, 207; 271/207, 209, 212, 161, 165

[56] References Cited

U.S. PATENT DOCUMENTS

| | | | |
|---|---|---|---|
| 4,458,890 | 7/1984 | Kawazu | 271/37 |
| 4,606,535 | 8/1986 | Larson | 271/10 |
| 4,640,502 | 2/1987 | Habich | 271/4 |
| 4,698,650 | 10/1987 | Watanabe | 346/134 |
| 4,754,290 | 6/1988 | Kitayama | 346/76 PH |
| 4,773,775 | 9/1988 | Bradshaw | 400/208 |
| 4,869,606 | 9/1989 | Lehmann | 400/208 |

FOREIGN PATENT DOCUMENTS

| | | | |
|---|---|---|---|
| 135040 | 10/1980 | Japan | 271/165 |
| 67278 | 6/1981 | Japan | 400/208 |
| 161179 | 1/1987 | Japan | 400/208 |
| 151367 | 7/1987 | Japan | 400/208 |
| 275343 | 11/1989 | Japan | 271/161 |
| 8200994 | 4/1982 | World Int. Prop. O. | 271/165 |

*Primary Examiner*—Edgar S. Burr
*Assistant Examiner*—Eric P. Raciti

[57] ABSTRACT

A device for loading an ink film and printing papers in a color video printer. The loading device comprises an integrated-type container for containing both of ink film and printing papers therein. The integrated-type container comprises an ink film cartridge portion formed at one side of the container, a printing papers receiving chamber formed at the other side of the container, and a guide opening formed between said ink film cartridge portion and said chamber. A printing paper guiding plate is fixedly mounted to the upper portion of the printer body in the interior of the printer body in order to guide the printing paper fed from the printing papers receiving chamber to the guide opening formed at the container.

2 Claims, 7 Drawing Sheets

DEVICE FOR LOADING INK FILM AND PRINTING PAPERS IN COLOR VIDEO PRINTER

BACKGROUND OF THE INVENTION

The present invention relates to a color video printer (C.V.P.), and more particularly to a color video printer with a device for loading an ink film and a printing paper therein.

Conventionally, such type of a color video printer comprises a main body 1 which has a first hole 1*a* for receiving a printing paper container 2 therein and a second hole 1*b* for receiving an ink film cartridge 3 therein, as shown in FIG. 1. The container 2 and the cartridge 3 are separately formed to contain printing papers and an ink film respectively. In FIG. 1, reference numeral "4" designates a key board.

FIGS. 2A and 2B are sectional views of inner and outer portions of the rear part of the color video printer shown in FIG. 1, respectively, showing a deck mechanism. In the drawings, reference numeral "2" designates the printing paper container which contains printing papers P therein, "3" the ink film cartridge which contains an ink film I therein, "5" a thermal head, and "6" a rotating lever.

Under the ink film cartridge 3, a capstan roller 7 and a pinch roller 8 are disposed. At the front of the rollers 7 and 8, a platen 9 is disposed to press the ink film I and the printing paper P to be printed against the thermal head 5. At the rear of the capstan roller 7, a paper discharging roller 10 and a paper discharging belt 10' are disposed, which operate in discharging the printing paper P. A paper supplying roller 11 and a paper supplying belt 11' are also disposed above the printing paper container 2. Under the printing paper container 2, a lever 12 is disposed, which functions to lift the printing paper P in supplying the printing paper.

In FIG. 2, reference numeral "13" designates a bottom plate on which printing papers P are supported, and "14", "15", and "16" designate motors, respectively.

The operation of the above-mentioned conventional apparatus will now be described.

FIG. 3 shows the condition when printing papers are supplied. As the lever 12 rotates upwardly by the driving force of the motor 15 and thus lifts the printing paper-supporting bottom plate 13 and the printing papers P, the uppermost printing paper P becomes in contact with the paper supplying belt 11' and thus moves forwardly, as shown in FIG. 3. Thereby, the printing paper P is pinched between the capstan roller 7 and the pinch roller 8 and fed to a printing position.

In printing, the platen 9 is in close contact with the thermal head 5 by the driving force of the motor 16. The printing paper P is fed in the direction opposite to that in supplying the printing paper P, as shown in FIG. 4. After printing, the printed paper P is discharged by the discharging belt 10' (see FIG. 2A). The lever 12, which has lifted the bottom plate 13 and the printing papers P in the paper supplying condition, returns to its original position by the reversed rotation of the motor 15 when the moved printing paper P is pinched between the capstan roller 7 and the pinch roller 8.

However, the above-mentioned ink film and printing paper loading device of the conventional color video printer has an ink film cartridge and a printing paper container which are separately formed and loaded in separately formed holes, respectively, thereby requiring an inconvenient double operation in use. Furthermore, the occupying space of the deck construction becomes large, thereby causing the overall size of the printer to be undesirably large.

SUMMARY OF THE INVENTION

Therefore, an object of the present invention is to eliminate the above-mentioned disadvantage encountered in the prior art and to provide a device for loading an ink film and printing papers in a color video printer, which enables convenient loading of the ink film and the printing papers by a single operation, actual reduction of the size of the container for the ink film and the printing papers, and thus compactness of the printer body.

In one aspect, the present invention provides a device for loading an ink film and printing papers in a color video printer which comprises a printer body provided at the interior thereof with a set of roller and belt for feeding printing papers, the device comprising: an integrated-type container for containing both of said ink film and printing papers therein; said container including an ink film cartridge portion formed at one side of the container and provided with a pair of reels on which the ink film is wound, a printing papers receiving chamber formed at the other side of the container and adapted to contain printing papers therein, and a guide opening formed between said ink film cartridge portion and said chamber and provided at the upper end thereof with an inlet and at the lower end thereof with an outlet; a receiving hole provided at the front face of said printer body to receive said container therein; means for supporting the container at position in the interior of the printer body; a printing paper guiding plate fixedly mounted to the upper portion of the printer body in the interior of the printer body and adapted to guide the printing paper fed from the printing papers receiving chamber by said roller and belt set to said inlet of the guide opening formed at the container.

In another aspect, the present invention provides an integrated-type container for an ink film and printing papers used for a color video printer comprising; an ink film cartridge portion formed at one side of said container and provided with a pair of reels on which the ink film is wound; a printing papers receiving chamber formed at the other side of the container and adapted to contain printing papers therein; and a guide opening formed between said ink film cartridge portion and said chamber and provided at the upper end thereof with an inlet and at the lower end thereof with an outlet.

BRIEF DESCRIPTION OF THE DRAWINGS

Hereinafter, the present invention will be more clearly described in conjunction with the annexed drawings, in which.

DETAILED DESCRIPTION OF THE PREFERRED EMBODIMENT

Figure 1:
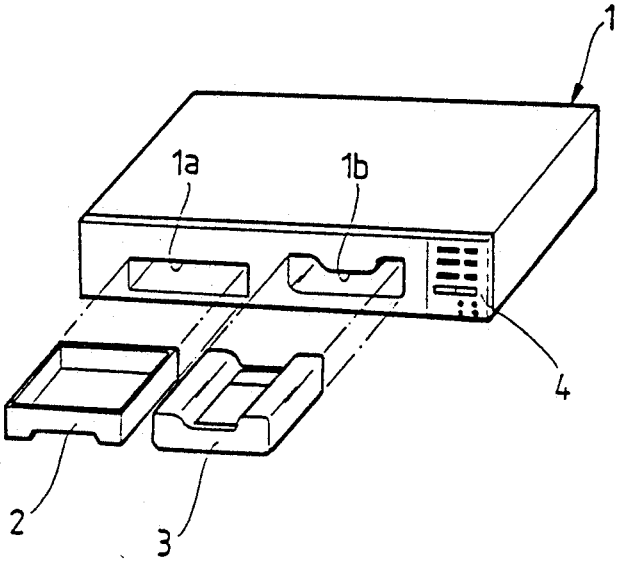
FIG.1 PRIOR ART
FIG. 1 is a perspective view of a color video printer according to a prior art from which an ink film container and a printing paper container are separated.
Figure 2A:
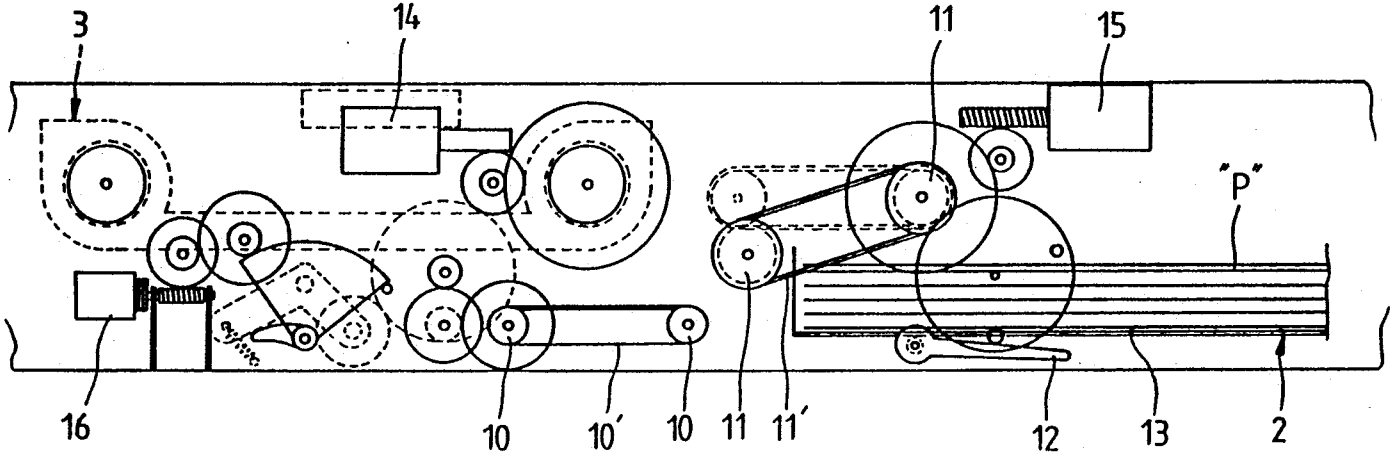
FIG. 2A PRIOR ART
FIGS. 2A and 2B are cross-sectional views showing a driving mechanism for the ink film and the printing papers in the color video printer according to the prior art.
Figure 2B:
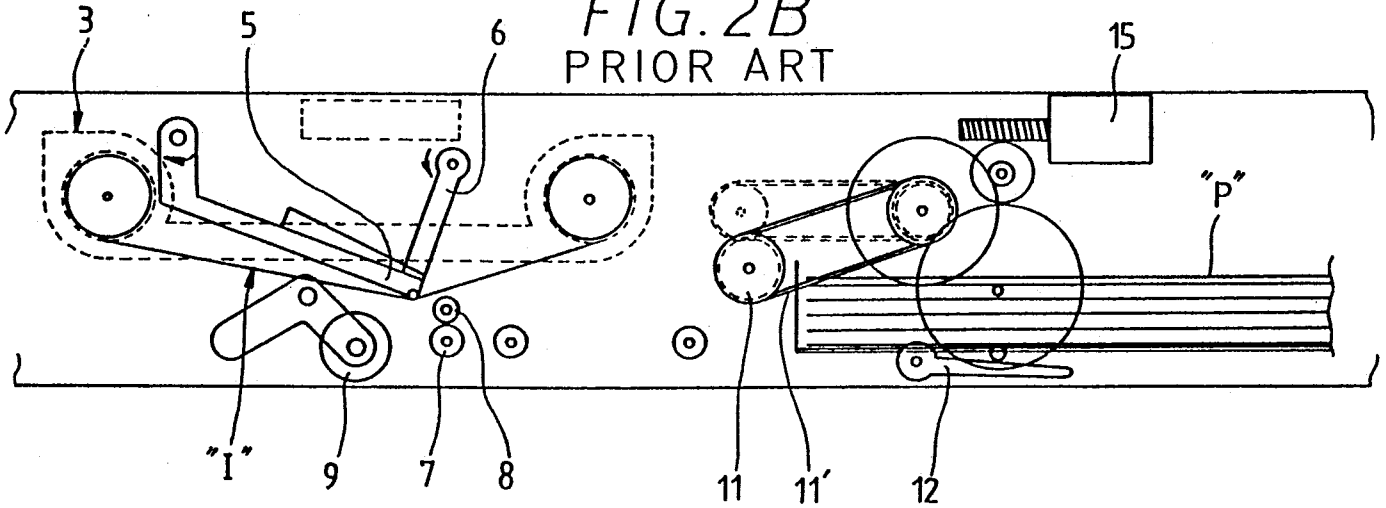
FIG. 2B PRIOR ART
Figure 3:
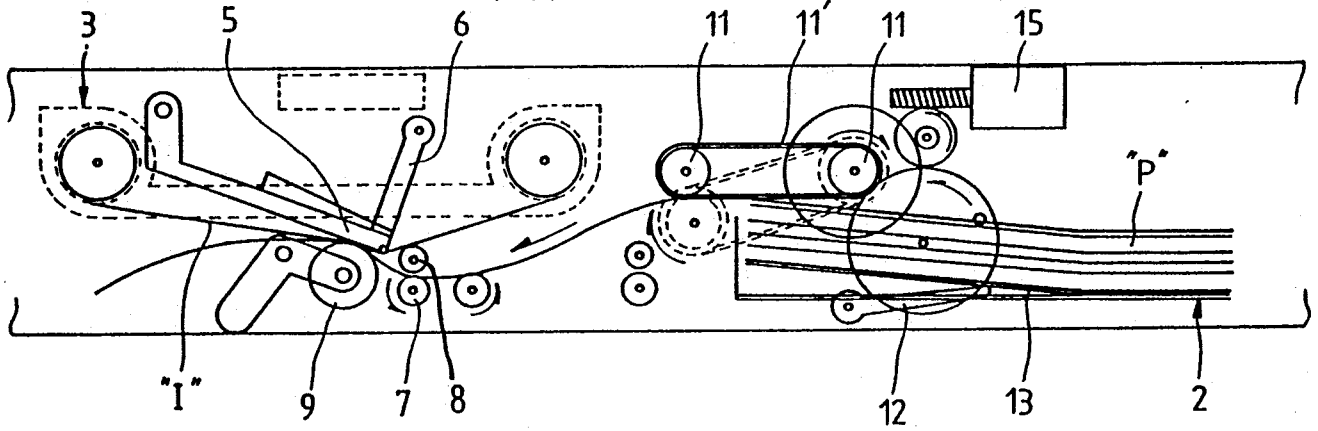
FIG. 3 PRIOR ART
FIGS. 3 and 4 are cross-sectional views showing operations of the driving mechanism shown in FIG. 2.
Figure 4:
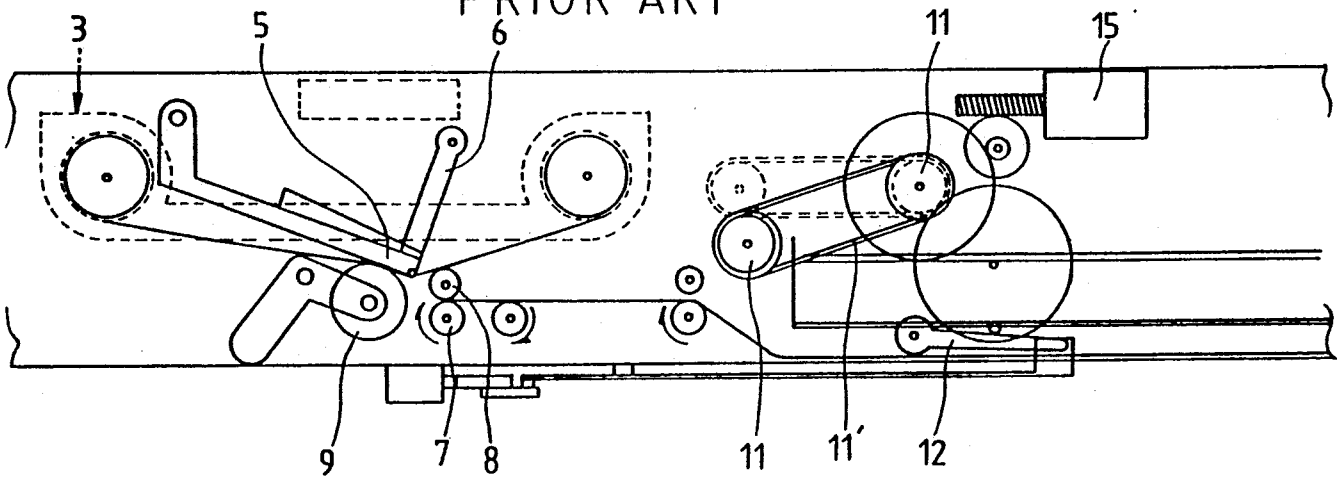
FIG. 4 PRIOR ART
Figure 5:
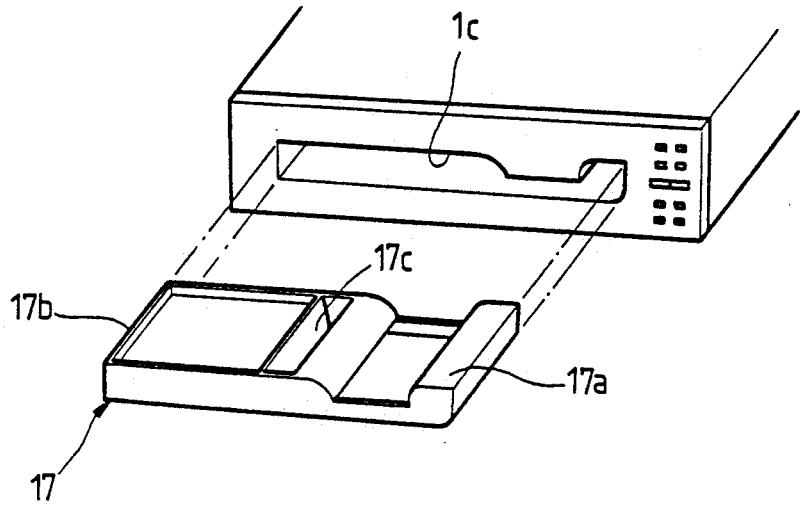
FIG. 5 is a perspective view of a color video printer according to the present invention from which an integrated-type container for ink film and printing papers is separated.

FIG. 5 is a perspective view showing a color video printer body and an integrated-type container for an ink film and printing papers in accordance with the present invention, said container being separated from the printer body. As shown in FIG. 5, the color video printer body 1 has a receiving hole 1*c* in which an integrated-type container for ink film and printing papers 17. The container 17 comprises an ink film cartridge portion 17*a* and a printing papers receiving chamber 17*b* which are laterally arranged. Between the ink film cartridge portion 17*a* and the printing paper receiving chamber 17*b*, a guide opening 17*d* is disposed, which has at the upper end a printing paper inlet 17*c* and at the lower end a printing paper outlet 17*e*.

Figure 6:
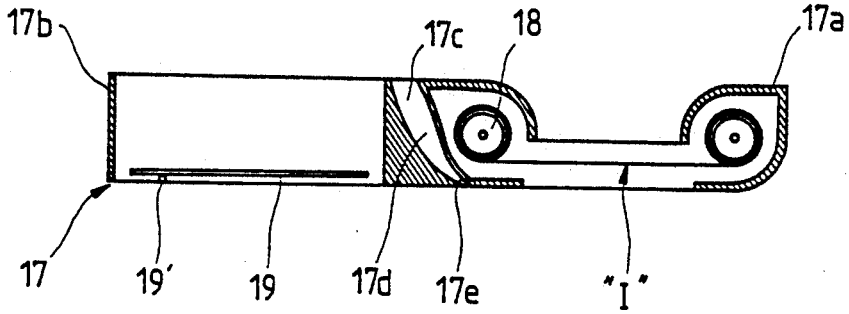
FIG. 6 is a cross-sectional view of the container shown in FIG. 5.

FIG. 6 is a cross-sectional view of the integrated-type container 17. Referring to FIG. 6, the ink film cartridge portion 17*a* is provided with a pair of reels 18 on which an ink film I is wound. The printing paper receiving chamber 17*b* is provided at the bottom thereof with a printing paper supporting plate 19 pivotally mounted by means of an elongated pin 19'.

Figure 7:
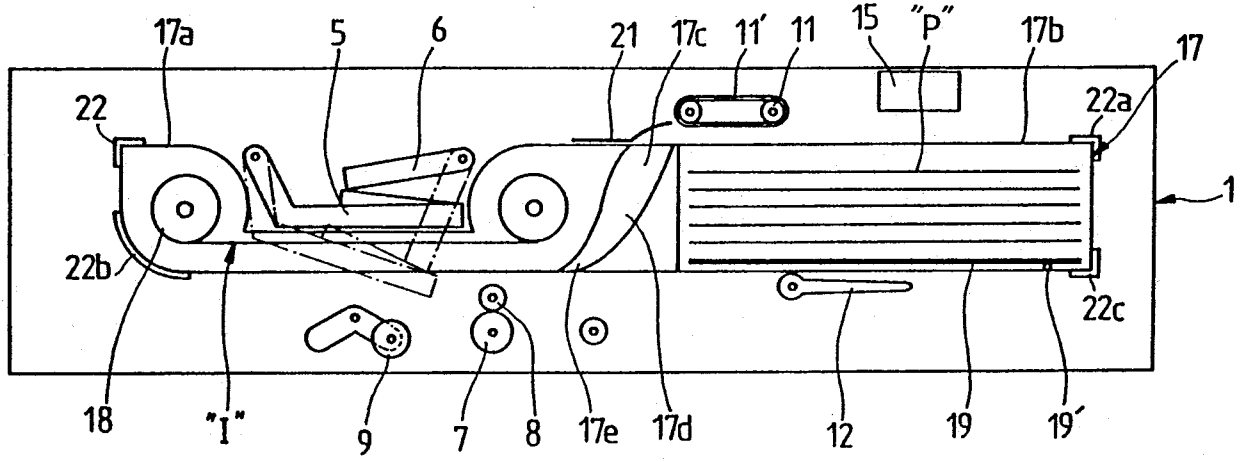
FIGS. 7 to 9 are cross-sectional views showing operations of a driving mechanism for the ink film and the printing paper according to the present invention.
Figure 8:
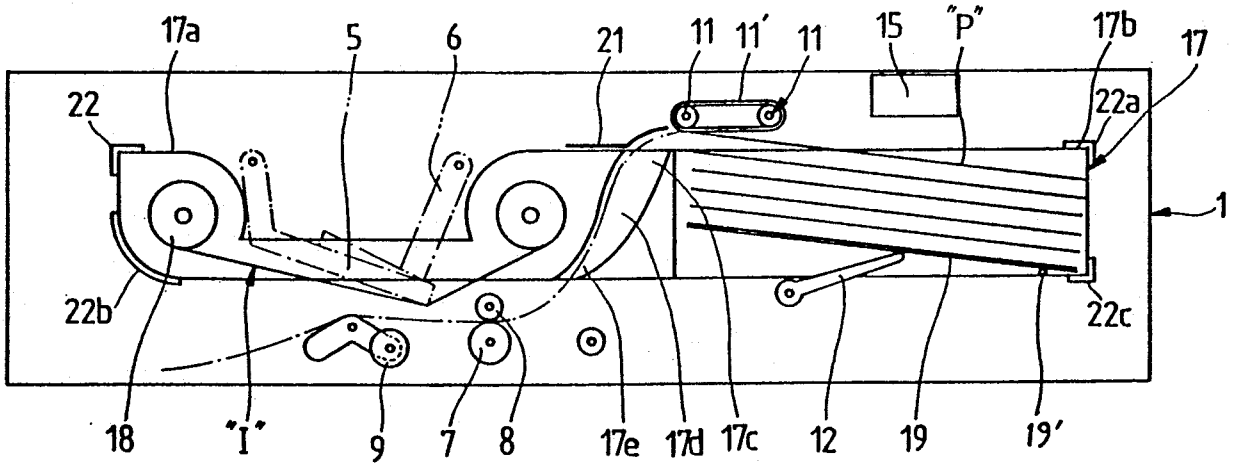

FIGS. 7 and 8 show an interior construction of the color video printer body in accordance with the present invention. In the drawings, the integrated-type container 17 is shown under the condition of being inserted in the interior of the printer body 1. In the interior of the printer body 1, there are support means such as guide plates 22, 22*a*, 22*b*, and 22*c* each fixedly mounted at the front and rear ends thereof to the front and rear chassis of the printer body 1. Guide plates 22, 22*a*, 22*b*, 22*c* function to support the integrated-type container 17 at its mounted position. The front and rear chassis has a mounting portion 20 to which a printing paper guiding plate 21 is mounted. The printing paper guiding plate 21 functions to guide a printing paper P extracted downward from the printing paper inlet 17*c* of the integrated-type container 17.

Figure 10:
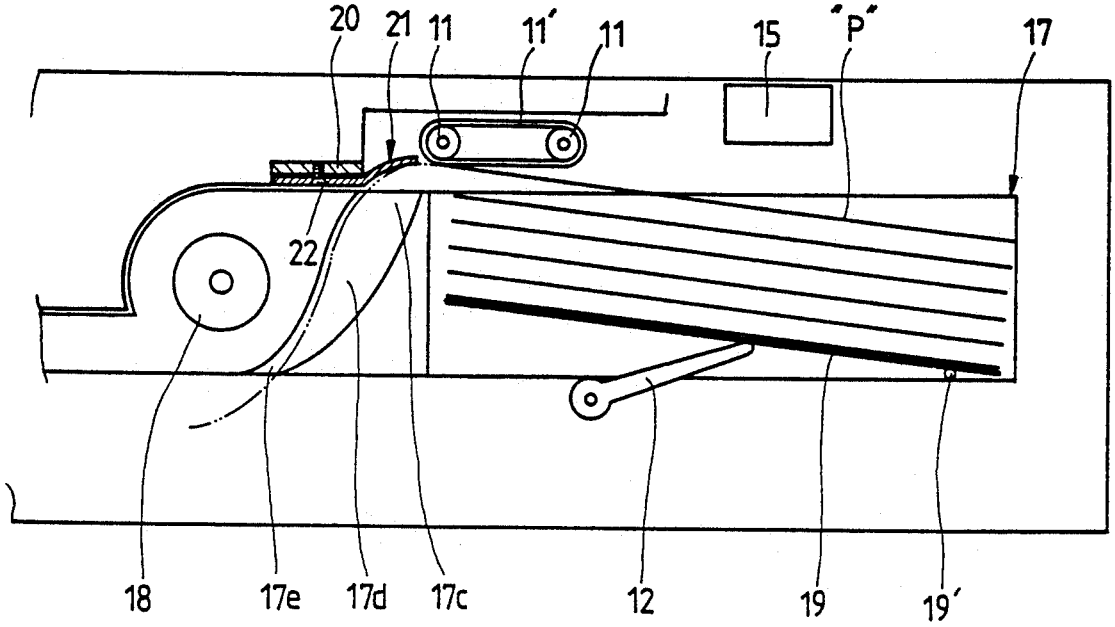
FIG. 10 is a partially enlarged sectional view of FIG. 9.
Figure 11A:
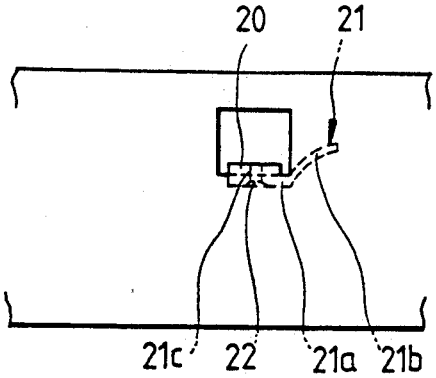
FIG. 11A is a front view of a guiding plate for the printing paper according to the present invention.
Figure 11B:
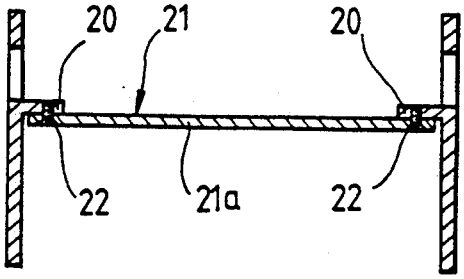
FIG. 11B is a longitudinal section view of a guiding plate shown in FIG. 11A.

FIGS. 10 and 11 show a mounting construction for the printing paper guiding plates 21. As shown in the drawings, the printing paper guiding plate 21 has a mounting portion 21*a* and an arc guide portion 21*b*, and mounting holes 21*c* perforated in said mounting portion 21*a*. The guiding plate 21 is fixedly mounted to the mounting portion 20 integrally formed with the front and rear chassis by means of fastening screws 22 inserted in the mounting holes 21*c*.

In the drawings, the elements identical to those of the conventional construction are designated by the same reference numerals as used in conjunction with the conventional construction.

Operation of the device in accordance with the present invention will now be described.

Figure 9:
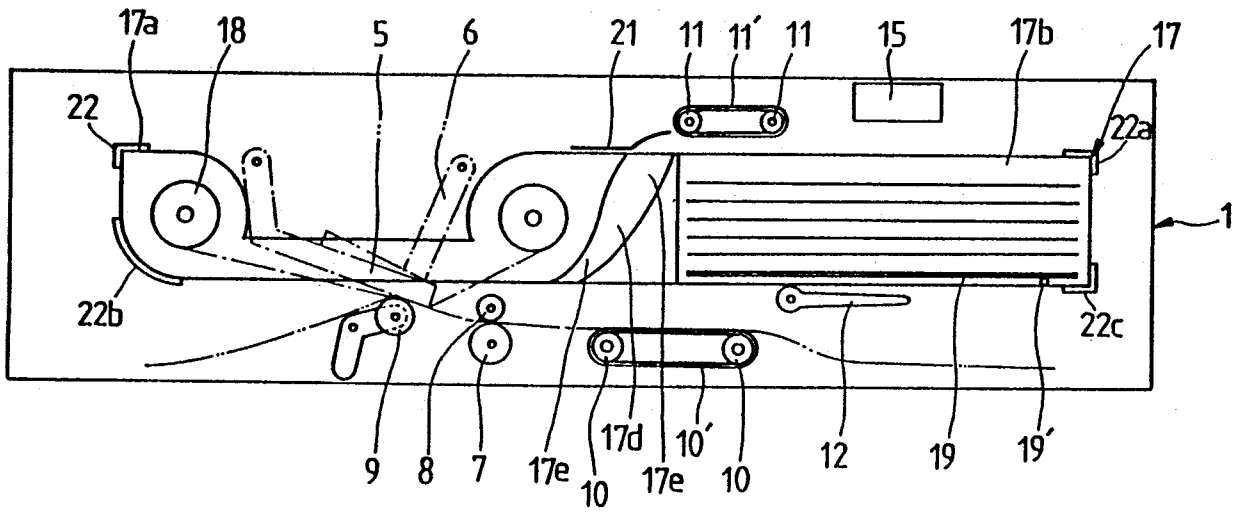

As the lever 12 is pivoted upwardly under the condition that the integrated-type container 17 has been loaded in the printer body 1, as shown in FIG. 7, the printing paper supporting plate 13 and the printing papers P are lifted upwardly, thereby causing the uppermost printing paper P to be brought into contact with the paper supplying belt 11'. As a result, the printing paper P is fed along the printing paper guiding plate 21 to the printing paper inlet 17*c* of the guide opening 17*d* provided between the ink film cartridge portion 17*a* and the printing paper receiving chamber 17*b*. Then the printing paper P is fed through the guiding opening 17*d* and discharged from the printing paper outlet 17*e*, so as to be pinched between the capstan roller 7 and the pinch roller 8. In printing, the printing paper P is pressed against the thermal head 5 by the platen 9 in a conventional fashion, as shown in FIG. 9. Under this condition, printing is carried out. In this printing, the printing paper to be printed is fed in the direction opposite to that in supplying the printing paper. Simultaneously with the completion of printing, the printed paper P is discharged by the paper discharging roller and the paper discharging belt 10'.

As apparent from the above description, The present invention enables a simplified single operation of the printer in virtue of the provision of the integrated-type container for containing both ink film and printing papers, as compared with the prior art which uses separately-formed ink film cartridge and printing paper container, thereby causing a double operation. The integrated-type container of the present invention also enables the storage thereof to be easy. The length of the container can also be reduced, thereby enabling the compactness of the printer, as compared with the prior art.

Although the preferred embodiment has been described, it will be obvious to one of ordinary skill that modifications may be made without departing from the true spirit and scope of the invention, which is to be limited only by the appended claims.

What is claimed is:

1. A color video printer comprising:

an integrated-type container for containing both ink film and printing paper therein, said container including an ink film cartridge portion formed at one side of the container and provided with a pair of reels on which the ink film is wound, a printing paper receiving chamber fixed in relation to the ink film cartridge at the other side of the container and adapted to contain printing papers therein, and a guide opening formed between said ink film cartridge portion and said chamber and provided at an upper end thereof with an inlet and at a lower end thereof with an outlet;

a receiving hole provided at the front face of a printer body to receive said container therein;

means for supporting the container at a predetermined position in the interior of the printer body;

a roller and belt set for feeding said printing papers;

a printing paper guiding plate fixedly mounted to the upper portion of the printer body of the interior of the printer body and adapted to guide the printing paper fed from the printing paper receiving chamber by said roller and belt set to said inlet of the guide opening formed at the container whereby the printing paper is passed through said guide opening;

printing means including a thermal print head and a platen roller located beneath the thermal print head for printing said printing paper fed from said printing paper receiving chamber; and means for discharging the printer paper printed by said printing means.

2. The color video printer in accordance with claim 1, wherein said printing paper guide plate comprises a mounting portion adapted to mount the guide plate to a mounting portion formed at front and rear ends thereof to a front and rear chassis fixedly mounted in the interior of the printer body, and an arc guide portion adapted to guide the printing paper.

* * * * *